US005393139A

United States Patent [19]

Thorson et al.

[11] Patent Number: 5,393,139

[45] Date of Patent: Feb. 28, 1995

[54] MIXING BLADE MOUNTING ASSEMBLY

[75] Inventors: John L. Thorson, Wauwatosa; Norman E. Anderson, Pewaukee, both of Wis.

[73] Assignee: Mixer Systems, Inc., Pewaukee, Wis.

[21] Appl. No.: 280,352

[22] Filed: Jul. 26, 1994

[51] Int. Cl.[6] ..... B28C 5/16

[52] U.S. Cl. ..... 366/65; 366/286; 366/326; 366/331

[58] Field of Search ..... 366/65, 66, 67, 64, 366/331, 326, 328, 279, 285, 286, 314, 205, 97, 98, 100

[56] References Cited

U.S. PATENT DOCUMENTS

| | | | |
|---|---|---|---|
| 2,677,533 | 5/1954 | McMurray | 366/285 |
| 3,081,983 | 3/1963 | Thibodeaux | 366/65 |
| 3,160,399 | 12/1964 | Harrison | 366/65 |
| 3,168,296 | 2/1965 | Cowley | 366/65 |
| 4,506,984 | 3/1985 | Strehlow . | |

OTHER PUBLICATIONS

Eirich Intensive Mixer Model DE22, pp. 1–6 (no date).

Rejmert Mixer Brochure, pp. 1–6 (no date).

*Primary Examiner*—Robert W. Jenkins

*Attorney, Agent, or Firm*—Andrus, Sceales, Starke & Sawall

[57] ABSTRACT

A mounting assembly for the primary mixing paddles in a pan-type mixer includes a single bolt paddle support arm mounting and adjustment device, and a two bolt paddle mounting feature, both of which are constructed and located to provide reliable adjustability and demountability and to protect the assemblies against the ingress of contaminants and abrasive wear from the materials being mixed. The single bolt clamping device also provides simple vertical adjustment of the paddle height in a manner which retains the adjustment mechanism enclosed against the entry of contaminants. The two bolt paddle mounting assembly encloses both threaded connections inside the body of the paddles, and includes a protective enclosing shroud and positions the exposed bolt heads at the back of the assembly out of the direct path of abrasive materials.

6 Claims, 2 Drawing Sheets

MIXING BLADE MOUNTING ASSEMBLY

BACKGROUND OF THE INVENTION

The present invention pertains to mixing apparatus for concrete and other materials and, more particularly, to an assembly for demountably and adjustably mounting the mixing blades in a rotary pantype mixer.

Pan mixers are well known in the art and are used to batch mix a wide variety of materials, including concrete, glass, foundry sand, and a variety of industrial by-products such as fly ash. Pan-type mixers typically utilize a shallow annular mixing chamber having a flat bottom and concentric outer and inner cylindrical side walls. The cylindrical inner side wall houses an appropriate rotary drive system which typically drives a variety of mixing and blending tools which depend downwardly into the mixing chamber for rotational movement therein. Because many of the materials which are mixed in a pan-mixer are highly abrasive, the rotational mixing, blending, and scraping tools are subject to extreme wear, even when made of wear-resistant metals. Thus, the positions of the tools must be periodically adjusted to maintain proper positioning with respect to the walls of the mixing chamber to compensate for wear and, further, must be demountable for replacement when excessive wear has occurred.

U.S. Pat. No. 4,506,984 shows a prior art pan-type mixer, including an assembly for demountably and adjustably attaching the main mixing paddles or blades for rotational movement in the mixing chamber over and closely spaced from the chamber bottom wall. This prior art paddle mounting assembly includes a downwardly depending paddle mounting arm having a bracket at its lower end to which the paddle is demountably attached. The attachment assembly includes a connector plate which slides in a T-shaped slot in the back of the paddle and has a pair of threaded studs extending out of the paddle slot and through a slotted mounting bracket to provide interim vertical adjustment of the paddle, as well as eventual removal for replacement. Another prior art arrangement utilizes a pair of mounting bolts which extend through the front face of the paddle with the bolt heads recessed in the paddle face and the opposite threaded ends extending through a mounting bracket and secured thereto with conventional nuts and lock washers.

In both of the foregoing prior art mounting assemblies, the mounting bolt pairs have threaded ends which are exposed to the abrasive action of the materials being mixed. In the latter prior art arrangement, the bolt heads are also exposed to abrasive action. In addition, when mixing materials such as concrete, cement typically builds up on all exposed surfaces, including the exposed threaded bolt ends, connecting nuts and bolt heads of the various prior art assemblies. As a result, the threaded connections become difficult or impossible to loosen and, when subjected to abrasive action for extended periods, may even wear to the point of failure.

Attempts have been made in the prior art to attach the paddle mounting arm with a vertically adjustable connection at its upper end above the normal level of material being mixed so that the paddle height is adjusted by vertical adjustment of the arm to which it is attached. However, these mounting assemblies have typically utilized two bolts or similar threaded connectors and complex adjustment mechanisms which are subject to infiltration by airborne cement and other dust which accumulates and cakes on the connectors and adjustment mechanism. One such adjustment mechanism is also shown in the above identified patent.

There is a need, therefore, for a simple paddle or blade mounting system for rotary pan-type mixers which is well protected from the abrasive action of materials being mixed, better sealed against infiltration of airborne cement fines and other dust particles, and is simple to adjust and disassemble for replacement.

SUMMARY OF THE INVENTION

In accordance with the present invention, a mixing paddle mounting assembly for a rotary pan mixer includes a two-element paddle mounting and adjustment assembly in which the threaded connectors for mounting the paddle have a minimum exposure to the abrasive action and undesirable build-up of materials being mixed, and vertical adjustment of the paddle is effected from above with a clamp assembly having a single bolted connection which encloses the bolt threads to minimize infiltration and contamination by airborne fines.

In accordance with one aspect of the invention, a paddle mounting assembly comprises a blade mounting arm which includes a generally vertically disposed arm segment, the lower free end of which is provided with a pair of vertically spaced generally horizontal through holes, a unitary mixing paddle having a grooved rear face which encloses the front face of the mounting arm and includes a pair of threaded blind bores aligned with the through holes in the end of the arm, and a pair of threaded mounting bolts which extend through the holes and into the threaded bores to secure the paddle to the mounting arm. The mixing paddle is preferably made of a wear resistant cast metal and the threaded blind bores are provided with coiled steel thread inserts.

In accordance with another aspect of the invention, the upper end of the mounting arm includes a vertically extending adjuster bar which has a generally rectangular horizontal cross section and a vertically elongated open slot which extends horizontally through the bar. A main support arm is mounted for rotation over the mixer pan and has a first clamp half fixed to one end which clamp half defines a first vertically extending rectangular slot. A second demountable clamp half defines a second vertically extending rectangular slot and the first and second slots form a main vertical passage which surrounds the adjuster bar. A single horizontally disposed threaded fastener extends through the second clamp half and the open slot in the adjuster bar and is secured in the first clamp half to secure the adjuster bar in a selected vertical position within the main passage. In the preferred construction, each of the opposite faces of the adjuster bar which defines an end of the open slot abuts a face of one of the first and second slots to seal the open slot in the adjuster bar against the entry of contaminants, such as cement dust. The first and second clamp halves are preferably formed from identical castings, most preferably steel castings.

DETAILED DESCRIPTION OF THE PREFERRED EMBODIMENTS

Figure 1:
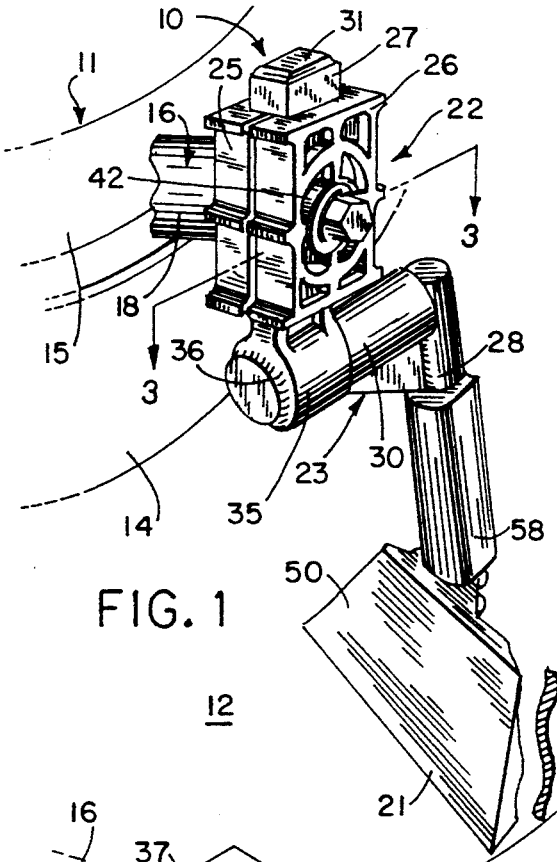
FIG. 1 is a perspective view of the inside of a portion of the mixing chamber of a pan-type mixer showing the mixing paddle mounting assembly of the present invention.
Figure 3:
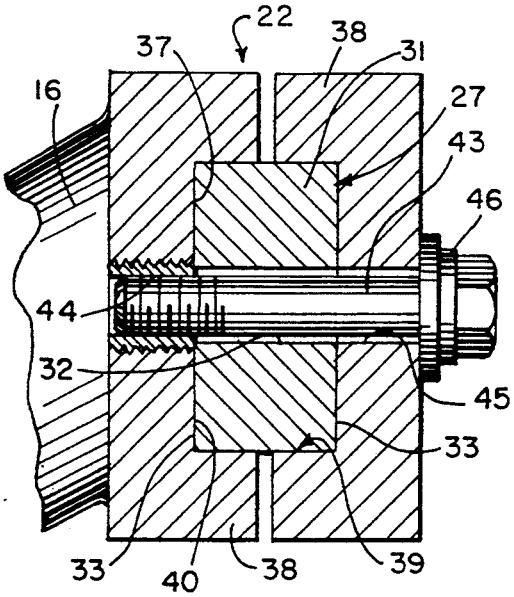
FIG. 3 is a sectional view taken on line 3—3 of FIG. 1.

Referring first to FIG. 1, the mixing chamber 10 of a pan-type mixer 11 includes a horizontal floor or lower wall 12, a cylindrical outer wall 13, and a concentric cylindrical inner wall 14. The annular mixing chamber 10 is stationary and the various walls 12, 13 and 14 defining the chamber may be constructed of wear-resistant replaceable segments, all in a manner well known in the art.

Various types of mixing, blending and scraping tools are supported above the mixing chamber for continuous circular movement within the chamber by a rotatable skirt 15 mounted above and concentric with the cylindrical inner wall 14 and driven by a suitable drive mechanism housed within the inner wall. A series of main support arms 16 are attached to the rotatable skirt 15 and extend generally radially outwardly over the mixing chamber 10. The main support arms 16 are typically of tubular construction and may be of circular or square cross section. In particular, the mounting assemblies for the two types of mixing paddles used in the mixer of the present invention include a short main support arm (not shown) which supports a radially inner paddle for travel over the lower wall 12 adjacent the cylindrical inner wall 14; and, a long main support arm 18 supporting a radially outer paddle 21 for travel over the lower wall adjacent the cylindrical outer wall 13. Both main support arms 17 and 18 are of circular tubular construction with the only significant difference being in their respective lengths. The radially outer ends of the support arms are each provided with a clamp assembly 22 which adjustably supports a paddle mounting arm 23 to the lower end of which is demountably attached one of the paddles 20 or 21. The mounting assemblies, including the clamp assembly 22 and paddle mounting arm 23, are identical for both support arms 17 and 18 and their respective paddles 20 and 21. The paddles are also virtually identical, except for their mirror image constructions.

An inner wall scraper blade (not shown) is also supported for rotation with the rotatable skirt 15 along the cylindrical inner wall 14. A similar outer wall scraper blade (not shown) is similarly supported for rotation on another type of mounting bracket for movement along the cylindrical outer wall 13.

The adjustable clamp assembly 22, paddle mounting arm 23 and mixing paddle 21 will be described for the long main support arm 18 shown in FIG. 1. However, the clamp assembly, mounting arm and mounting assembly for the inner paddle 20 is essentially identical.

Figure 2:
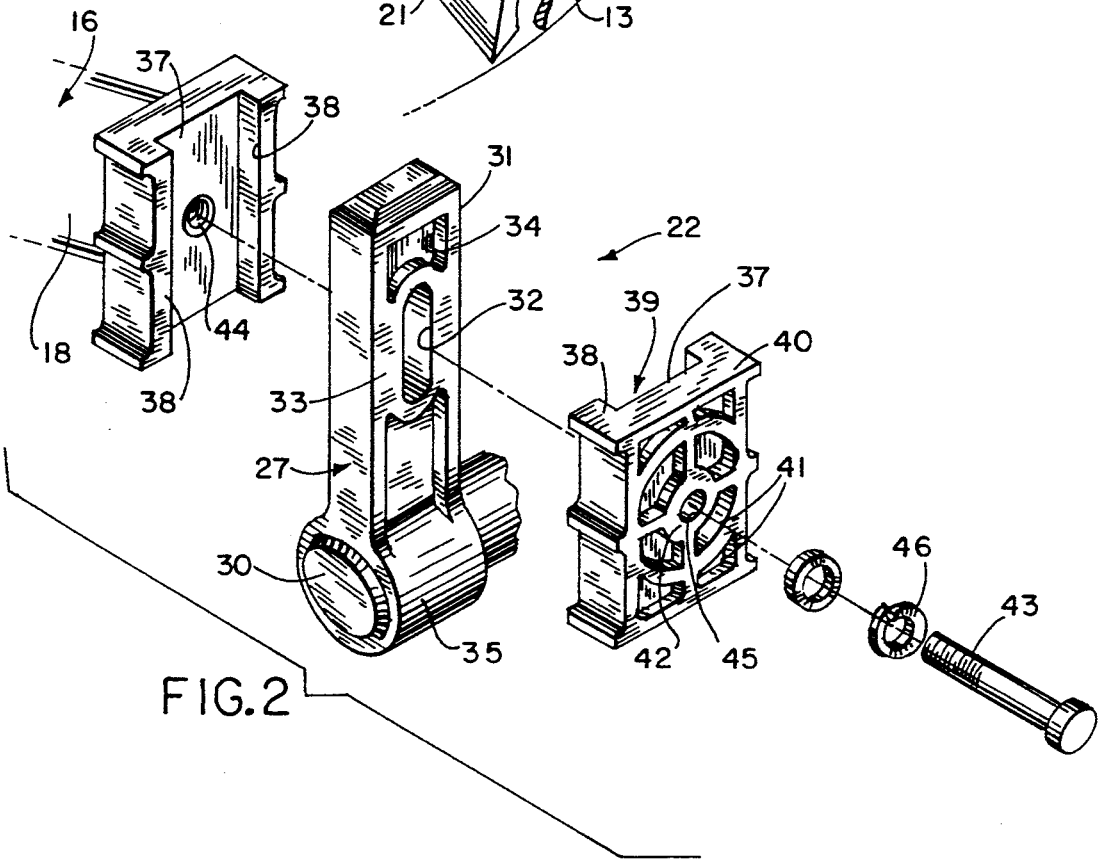
FIG. 2 is an exploded view of the mounting assembly of FIG. 1.

The clamp assembly 22 includes a first clamp half 25 which is fixed, as by welding, to the end of the main tubular support arm 18. An identical second clamp half 26 is demountably attached to the first clamp half and cooperates therewith to provide vertical adjustable positioning of an adjuster bar 27 forming the upper end of the paddle mounting arm 23. Referring also to FIG. 2, the paddle mounting arm 23 includes a lower vertical arm segment 28 to the lower end of which the mixing paddle 21 is demountably attached, an integral upper horizontal arm segment 30 which is fixed to and extends away from the lower end of the adjuster bar 27.

The adjuster bar 27 includes an upper end 31 of generally rectangular horizontal cross section that is provided with a vertically elongated open slot 32 which extends through the bar between opposite faces 33. The upper end 31 of the bar may be cast with appropriate recesses 34 to provide a saving in weight and material without sacrificing strength. The lower end 35 of the adjuster bar 27 includes an integral cylindrical sleeve 36 sized to receive therein the end of the horizontal arm segment 30 which is permanently secured therein, as with a weld. The cross section of the adjuster bat 27 does not have to be rectangular, but may be of any non-circular shape which prevent rotation when mounted in the clamp assembly 22, as will be described.

Each of the clamp halves 25 and 26 has a generally U-shaped vertically extending rectangular slot 37 defined by a pair of legs 38 interconnected by a base 40. When the clamp halves 25 and 26 are placed together with the legs 38 in juxtaposed relation, the rectangular slots 37 define a main vertical passage 39 which receives and surrounds the upper end 31 of the adjuster bar 27.

The clamp halves 25 and 26 are, like the adjuster bar 27, preferably made of steel castings and they also will be provided with suitable recesses 41. Each of the clamp halves 25 and 26 includes a central boss 42 which, in the first clamp half 25, is tapped to provide a threaded bore 44 to receive the threaded end of a clamping bolt 43 and, in the second clamp half 26, is provided with a through bore 45 for passage of the clamping bolt therethrough. The clamping bolt also passes through the open slot 32 in the adjuster bar when it is positioned in the main vertical passage 39 defined by the rectangular slots 37. As the clamping bolt is turned into the threaded bore 44 in the first clamp half, the adjuster bar is clamped between the two halves 25 and 26. By sliding the adjuster bar 27 vertically in the main passage 39, the position of the lower edge of the paddle 21 with respect to the lower wall 12 of the mixing chamber may be set as desired. A clearance of, for example, $\frac{1}{4}$ inch is typical.

The width of the rectangular slots 37 in the clamp halves 25 and 26 is just slightly larger than the width of the adjuster bar 27, so that the latter is received in the slots with a sliding fit. However, the combined depth of both slots 37 (twice the height of the legs 38) is somewhat less than the thickness of the adjuster bar 27 between the opposite faces 33 thereof. In this manner, a true clamping is effected between the bases 40 of the slots and the respective faces 33 on the adjuster bar.

The clamp assembly 22, utilizing a single clamping bolt 43, provides easy assembly, as well as simple adjustability after installation and operation. As the lower edge of the paddle 21 wears as a result of abrasive action in use, it will eventually become necessary to move the paddle vertically downwardly. The clamping bolt 43 (preferably having a lock washer 46 interposed between the bolt head and the face 33 of the bar surrounding the bore 45) is loosened slightly and the upper end 31 of the adjuster bar is tapped to move the bar vertically downwardly, carrying therewith the entire paddle mounting arm 23 and paddle 21 to reset the vertical positioning. The close fit of the adjuster bar 27 in the vertical passage 39 formed by the clamp half slots 37 helps prevent the entry of dust, dirt and other debris so there is little likelihood of a build up and caking of material in the open slot 32 which provides vertical adjustability to the paddle mounting assembly. The threaded connection between the end of the clamping bolt 43 and the threaded bore 44 in the first clamp half 25 is also completely enclosed and protected from contamination and build up of material which might otherwise adversely affect its operability.

Figure 4:
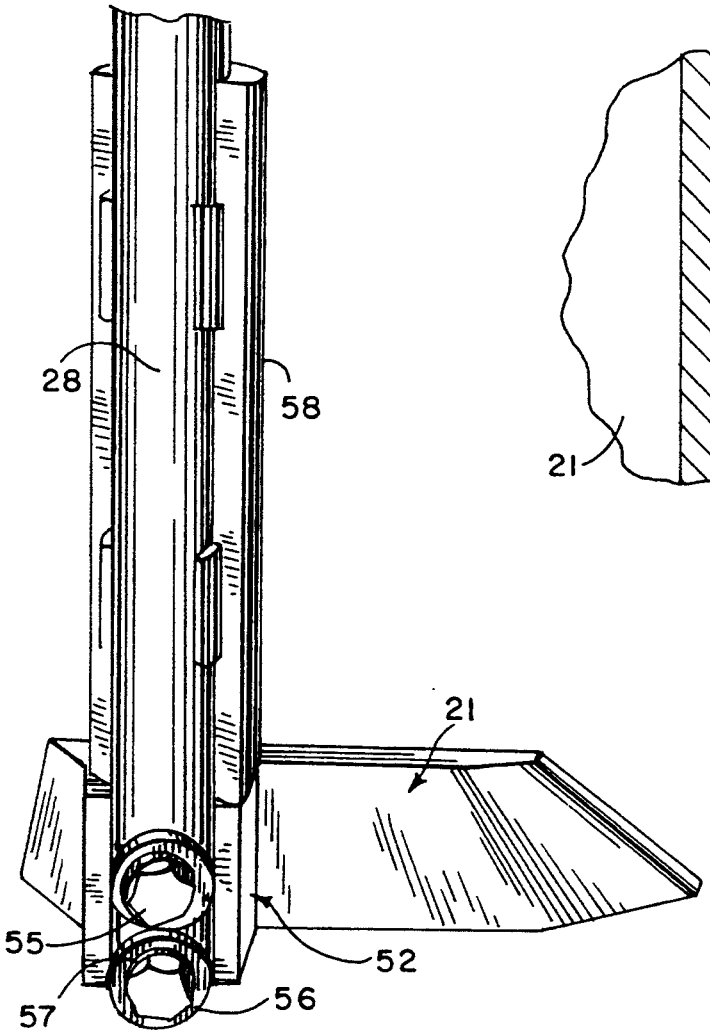
FIG. 4 is a rear elevation of the assembly for demountably attaching the paddle to the lower end of the mounting arm.
Figure 6:
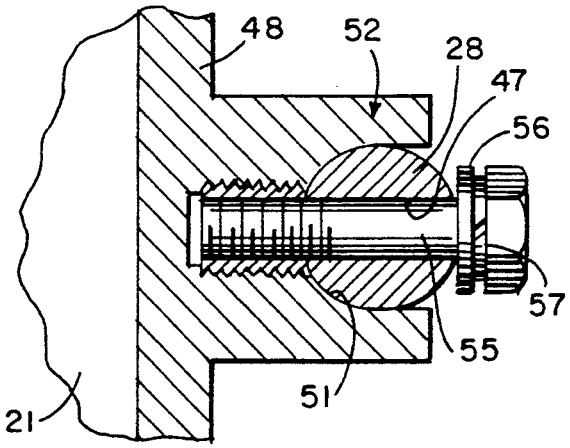
FIG. 6 is a sectional view taken on line 6—6 of FIG. 5.
Figure 5:
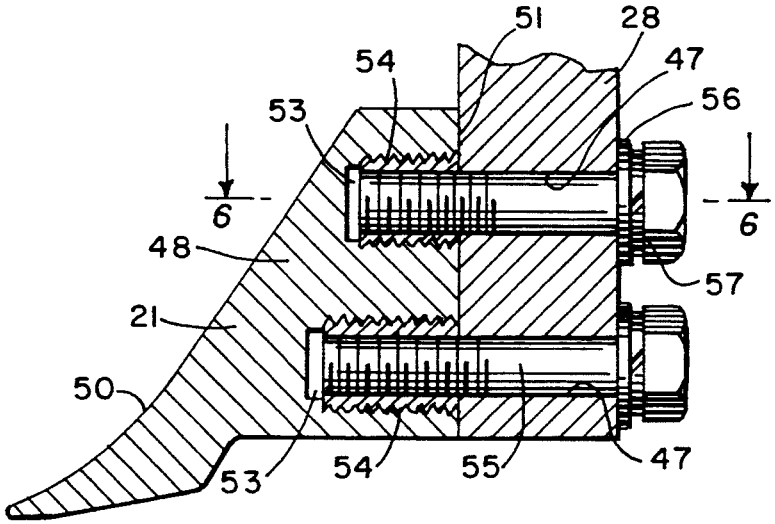
FIG. 5 is a sectional side elevation of the paddle mounting arrangement of FIG. 4.

Referring now also to FIGS. 4–6, the mixing paddle 21 is demountably attached the paddle mounting arm 23 in a manner which substantially enhances the protection of the mounting assembly against abrasive action from the material being mixed and also protects the threaded connections which are used against a detrimental build up of material in the mixing chamber. The mixing paddles 20 and 21 both operate along the bottom of the mixing chamber 10 and, therefore, are always fully submerged and operating in the hostile and abrasive environment of the material being mixed. This improved aspect of the paddle mounting assembly enhances the protection from abrasion, yet provides easy demountability of the paddles.

The paddle mounting arm 23, including the vertical arm segment 28 to which the paddle is attached, is formed from a solid steel bar of circular cross section having a diameter, for example, of 2 inches. A pair of vertically spaced and generally horizontal paddle mounting holes 47 are provided in the lower end of the vertical arm segment 28. The outer paddle 21 shown in FIG. 4 and the similar inner paddle 20 are made from a hardened and wear resistant metal casting. Each paddle includes a main body 48 having a forward concave mixing face 50. The back face of the paddle is formed with a vertically disposed semicylindrical groove 51 sized and shaped to receive the cylindrical surface of the vertical arm segment 28. The legs which define the semicylindrical groove 51 provide a shroud 52 which covers the forward facing portion of the end of arm segment 28 including the paddle mounting holes 47. A pair of vertically spaced blind bores 53 are formed in the base of the groove 51 at the same spacing as the paddle mounting holes 47. The bores 53 are tapped to receive threaded fasteners and, preferably, are provided with coiled steel thread inserts 53 of a type well known in the industry. The hardened steel thread inserts provide a more compatible threaded engagement for the pair of mounting bolts 55 which are inserted from the backside through the paddle mounting holes 47 and into the threaded blind bores 53. The mounting bolts may utilize a conventional bearing washer 56 and lock washer 57, as shown.

The threaded portions of the mounting bolts 55 and the threaded bores 53 in which the bolts are received are completely enclosed within the paddle 21 and arm segment 28. In addition, the shroud 52 formed on the backside of the paddle protects against the ingress of powders, dust and other contaminants and protects the lower end of the mounting arm segment 28 against abrasion. The only portions of the paddle mounting assembly which are exposed to the material being mixed in the mixing chamber are the heads of the bolts 55 and the washers 56 and 57. However, these elements are on the backside of the assembly and not exposed directly to the abrasive action of the materials being mixed. As is conventional in this type of pan mixer, the forward facing portion of the mounting arm segment 28 above the paddle 21 may be protected against abrasion by a rubber wear guard 58.

Various modes of carrying out the present invention are contemplated as being within the scope of the following claims particularly pointing out and distinctly claiming the subject matter which is regarded as the invention.

We claim:

1. A mixing paddle mounting assembly for a rotary pan-type mixer comprising:

a paddle mounting arm including a generally vertically disposed arm segment having a free lower end;

a pair of vertically spaced generally horizontal through holes in the lower end of said mounting arm segment;

a unitary mixing paddle including a front mixing face and a rear mounting face having a vertically extending groove adapted to receive and enclose therein one face of the lower end of the arm segment, said groove having a pair of threaded blind bores aligned with said through holes; and, a pair of threaded mounting bolts extending through said holes and into said threaded bores to secure the paddle to the mounting arm.

2. The mounting assembly as set forth in claim 1 wherein the mixing paddle is made of cast metal and the threaded bores are provided with coiled steel thread inserts.

3. A mixing paddle mounting assembly for a rotary pan-type mixer comprising:

a paddle mounting arm having a vertically extending lower end to which is demountably attached a mixing paddle;

said mounting arm including an upper end having fixed thereto a vertically extending adjuster bar, said adjuster bar having a non-circular horizontal cross section and a vertically elongated open slot extending horizontally therethrough;

a main support arm mounted for rotation over the mixer and having a first clamp half fixed to one end thereof, said first clamp half defining a first vertically extending non-circular slot;

a second demountable clamp half defining a second vertically extending rectangular slot;

said first and second slots forming a main vertical passage surrounding said adjuster bar; and, a horizontally disposed threaded fastener extending through said second clamp half and said open slot and secured in said first clamp half to clamp said adjuster bar in a selected vertical position in said main passage.

4. The mounting assembly as set forth in claim 3 wherein said non-circular cross section and said first and second slots are rectangular.

5. The mounting assembly as set forth in claim 3 wherein each of the opposite faces of the adjuster bar defining an end of said open slot abuts a face of one of said first and second slots to seal the open slot against the entry of contaminants.

6. The mounting assembly as set forth in claim 3 wherein said first and second clamp halves are formed from identical castings.

* * * * *